United States Patent [19]

Cheng-Chung

[11] Patent Number: 4,990,060

[45] Date of Patent: Feb. 5, 1991

[54] AIR PUMP WITH SECONDARY AIR INLET

[75] Inventor: Wang Cheng-Chung, Taipei, Taiwan

[73] Assignee: Team Worldwide Corporation, Taiwan

[21] Appl. No.: 485,774

[22] Filed: Feb. 21, 1990

Related U.S. Application Data

[62] Division of Ser. No. 326,105, Mar. 20, 1989, abandoned.

[51] Int. Cl.[5] ..... F04B 23/08

[52] U.S. Cl. ..... 417/84; 417/87; 417/182

[58] Field of Search ..... 417/84, 87, 182

[56] References Cited

U.S. PATENT DOCUMENTS

| | | | |
|---|---|---|---|
| Re. 27,860 | 1/1974 | Day | 417/191 |
| 2,598,884 | 6/1952 | Brady, Jr. | 417/84 |
| 3,591,314 | 7/1971 | Day | 417/191 |
| 4,513,784 | 4/1985 | Farrand et al. | 137/854 |
| 4,805,661 | 2/1989 | Knapp et al. | 137/854 |
| 4,818,389 | 4/1989 | Tobias et al. | 417/87 |
| 4,880,358 | 11/1989 | Lasto | 417/182 |

*Primary Examiner*—Michael Koczo
*Assistant Examiner*—M. Kocharov
*Attorney, Agent, or Firm*—Silverman, Cass & Singer, Ltd.

[57] ABSTRACT

An air pump for inflating an inflatable article includes a multi-stage centrifugal compressing section for inhaling and compressing primary air and a secondary air inhaling mechanism provided downstream of the multi-stage centrifugal compressing section. At the beginning of the inflation operation, extra secondary air can be rapidly inhaled into the air pump and delivered into the inflatable article mainly by means of the secondary air inhaling mechanism and thereafter, when the inner pressure of the inflatable article gradually increases to exceed the predetermined level, the secondary air inhaling mechanism may be closed so that only the multi-stage centrifugal compressing section for primary air functions to continue the subsequent inflation operation in a higher pressure range. Thus, an ideal and speedy inflation operation may be achieved without reducing the inflation pressure.

6 Claims, 6 Drawing Sheets

AIR PUMP WITH SECONDARY AIR INLET

This is a divisional of co-pending application Ser. No. 07/326,105 filed Mar. 20, 1989, abandoned.

FIELD OF THE INVENTION

This invention relates to an air pump provided with a secondary air inlet, in addition to an intake conduit for primary air, so as to accelerate the inflation operation by the air pump. The air pump of this invention is particularly adapted for the inflation of inflatable toys or similar articles whose necessary inner pressures are within a range, for example, between approximately 0.6 psi and 1.0 psi.

BACKGROUND OF THE INVENTION

Reciprocating air pumps have been adopted as the most common tools for the inflation of inflatable articles in which the required inner pressures are within a comparatively higher range. On the other hand, in the inflation operation for inflatable articles of lower inner pressures, the most popular tools have been multi-stage centrifugal compressors which, instead of compressing the air to a higher pressure at a speed quite low as for reciprocating air pumps, can compress the air in a more speedy manner as compared with the reciprocating types.

A conventional multi-stage centrifugal compressor or air pump as shown in FIGS. 1 through 3 generally comprises: an intake conduit 1 for introducing the air into the air pump; a motor chamber 3 received therein with a motor 31 whose shaft 32 provides rotation power to the air pump; a multi-stage centrifugal compressing section 2 composed of several compressing units 5 which are connected in series and are driven by the motor shaft 32 for compressing the air by centrifugal force; a discharge conduit 4 for introducing the compressed air into the interior of an article to be inflated. Each compressing unit 5 (see FIGS. 2 and 3 wherein two consecutive compressing units 5 are shown) comprises a rotor 51 which is fixed to the motor shaft 32 and can rotate together with the shaft 32, and a stator 52 which is fixed to the housing of the air pump. The stator 52 comprises a disk-shaped spacing plate 56 having a central hole 58 provided at the center thereof, and an annular portion 57 integrally formed with and perpendicular to the periphery of the disk-shaped spacing plate 56. Each rotor 51 is received within the cavity formed by the spacing plate 56 and the annular portion 57 of a stator 52. The rotor 51 comprises a generally disk-shaped base plate 53, a plurality of blades 54 integrally formed with and supported by the base plate 53, and a hollow hub 55 protruding axially from the central portion of the base plate 53 whereby the rotor 51 may be fixed to the motor shaft 32 by fitting the hub 55 onto the shaft 32. FIG. 3 illustrates how the parts shown in FIG. 2 are assembled onto the motor shaft 32 to form two compressing units 5, and how the air is forced to flow through each compressing unit 5 along the directions of the arrows shown in FIG. 3 and compressed. The air to be compressed enters each compressing unit 5 from the right side, and is forced to move radially outwards by the centrifugal force produced due to the rotation of the blades 54 of the rotor 41. Then, when the air reaches the annular portion 57 of the stator 52, it is forced to overpass the outer periphery of the base plate 53 and reach the back end of the latter through the gap between the outer periphery of the base plate 53 and the inner periphery of the annular portion 57. Further, the air is forced to enter the adjacent compressing unit 5 through the central opening 58 of the spacing plate 56, thereby completing one stage of the air compression operation. Similar processes are repeated in the compressing units 5 connected in series so as to finally complete the whole multi-stage compression of the air. However, due to the fact that the air to be compressed must pass through a very narrow, long and winding passage during the compression operation, this type of multi-stage centrifugal compressor or air pump still suffers from the drawback of being incapable of inflating at a satisfactory speed, especially for the inflation of an inflatable article having a comparatively large volume when inflated.

SUMMARY OF THE INVENTION

The primary object of this invention is to provide a novel air pump wherein a secondary air inhaling mechanism, capable of inhaling air onto the air pump through a secondary air inlet in a speedy manner, is provided downstream of a multi-stage centrifugal compressing section for primary air so that air can be rapidly introduced into the air pump and delivered into an inflatable article mainly by means of the secondary air inhaling mechanism at the beginning of the inflation operation and thereafter, when the inner pressure of the inflatable article gradually increases to a predetermined extend, the secondary air inhaling mechanism may be closed so that only the multi-stage centrifugal compressing section for primary air continues the subsequent inflation operation in a higher pressure range. Thus, an ideal and speedy inflation operation may be achieved without reducing the inflation pressure.

In accordance with the first aspect of this invention, the air pump for inflating an inflatable article comprises: a housing; a primary intake conduit for introducing primary air into the air pump; a motor including a shaft for providing rotation power to the air pump; a multi-stage centrifugal compressing section for compressing primary air; a discharge conduit downstream of the multi-stage centrifugal compressing section for delivering compressed air onto the inflatable article, the discharge having a nozzle-like profile capable of accelerating the air passing therethrough; at least one secondary air inlet, provided between the multi-stage centrifugal compressing section and the discharge conduit, through which secondary air can be introduced into the air pump; and a secondary air intake pipeline through which secondary air may be inhaled into the air pump. The multi-stage centrifugal compressing section includes a plurality of compressing units connected in series and driven by the motor shaft. Each of the compressing units includes a stator fixed to the housing of the air pump, and a rotor which is fixed to the motor shaft and is received within a corresponding stator. Each rotor includes a base plate and a plurality of blades formed on the base plate so that air entering each compressing unit may be compressed gradually by the centrifugal force produced due to the rotation of the blades together with the motor shaft. The secondary air intake pipeline includes a secondary air exit pipe communicating into the discharge conduit and a connecting pipe interconnecting the secondary air inlet and the secondary exit pipe. Thus, thanks to a lower pressure produced by accelerated primary air in the vicinity where the secondary air exit pipe communicates into the discharge conduit, extra secondary air outside of the air pump may be inhaled into the air pump to accelerate the inflation operation.

In accordance with the second aspect of this invention, the air pump for inflating an inflatable article comprises: a housing; a primary intake conduit for introducing primary air into the air pump; a motor including a shaft for providing rotation power to the air pump; a multi-stage centrifugal compressing section for compressing primary air; a discharge conduit downstream of the multi-stage centrifugal compressing unit for introducing the compressed air into the inflatable article, the discharge conduit having a nozzle-like profile capable of accelerating the air passing therethrough; at least one secondary air inlet, between the multi-stage centrifugal compressing unit and the discharge conduit, through which secondary air may be introduced into the air pump; a blower located downstream of the at least one secondary air inlet and driven by the motor shaft for inhaling the secondary air into the air pump at the beginning of compression operation; and at least one air valve for allowing or prohibiting the passage or entrance of secondary air into the air pump. The multi-stage centrifugal compressing section includes a plurality of compressing units connected in series and driven by the motor shaft. Each of the compressing units includes a stator fixed to the housing of the air pump and a rotor which is fixed to the motor shaft and is received within a corresponding stator. Each rotor includes a base plate and a plurality of blades formed on the base plate so that air entering each compressing unit may be compressed gradually by the centrifugal force produced due to the rotation of the blades together with the motor shaft. Each air valve is mounted in a secondary air inlet for allowing the secondary air into the air pump when the inner pressure of the inflatable article is within a predetermined lower range, while prohibiting the air from passing therethrough when the inner pressure of the inflatable article is over the predetermined range.

BRIEF DESCRIPTION OF THE DRAWINGS

This invention will be more fully understood with reference to the following detailed description and accompanying drawings.

DETAILED DESCRIPTION OF THE PREFERRED EMBODIMENTS

Figure 1:
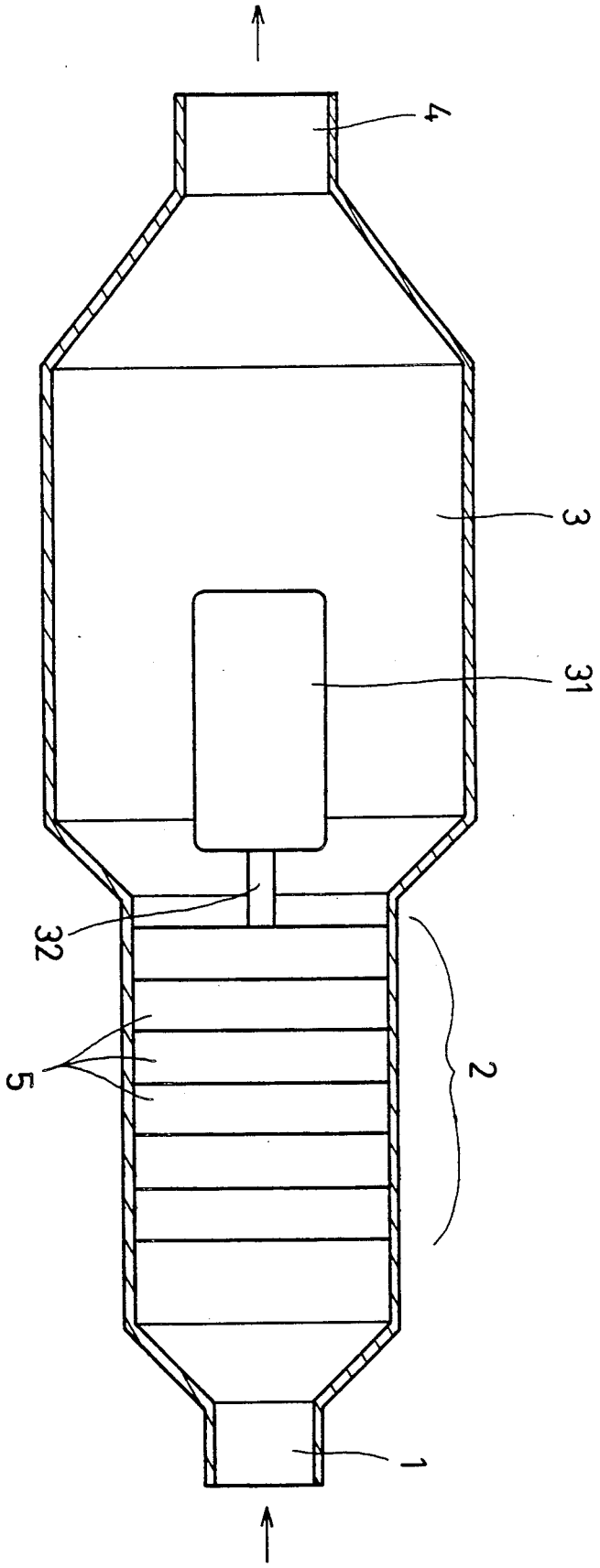
FIG. 1(PRIOR ART)
FIG. 1 is a schematic sectional view of a conventional multi-stage centrifugal compressor or air pump.
Figure 2:
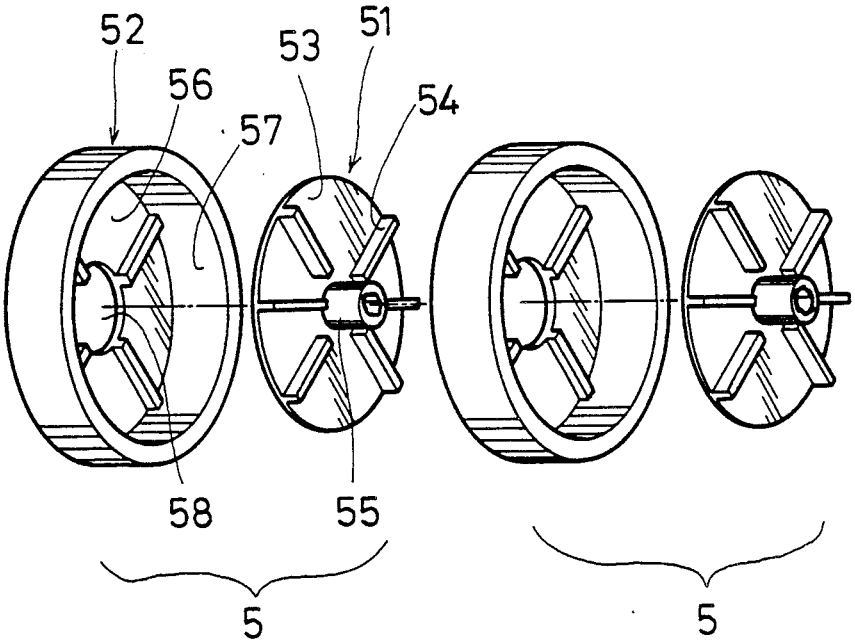
FIG. 2(PRIOR ART)
FIG. 2 is an exploded perspective view of two consecutive compressing units of a multi-stage centrifugal compressing section in the conventional air pump shown in FIG. 1.
Figure 3:
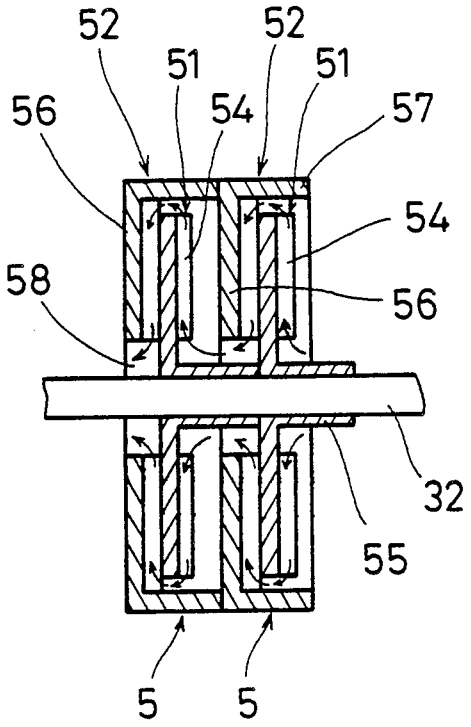
FIG. 3(PRIOR ART)
FIG. 3 is an assembly sectional view of the various members shown in FIG. 2 as well as the shaft 32 of the motor 31.
Figure 4:
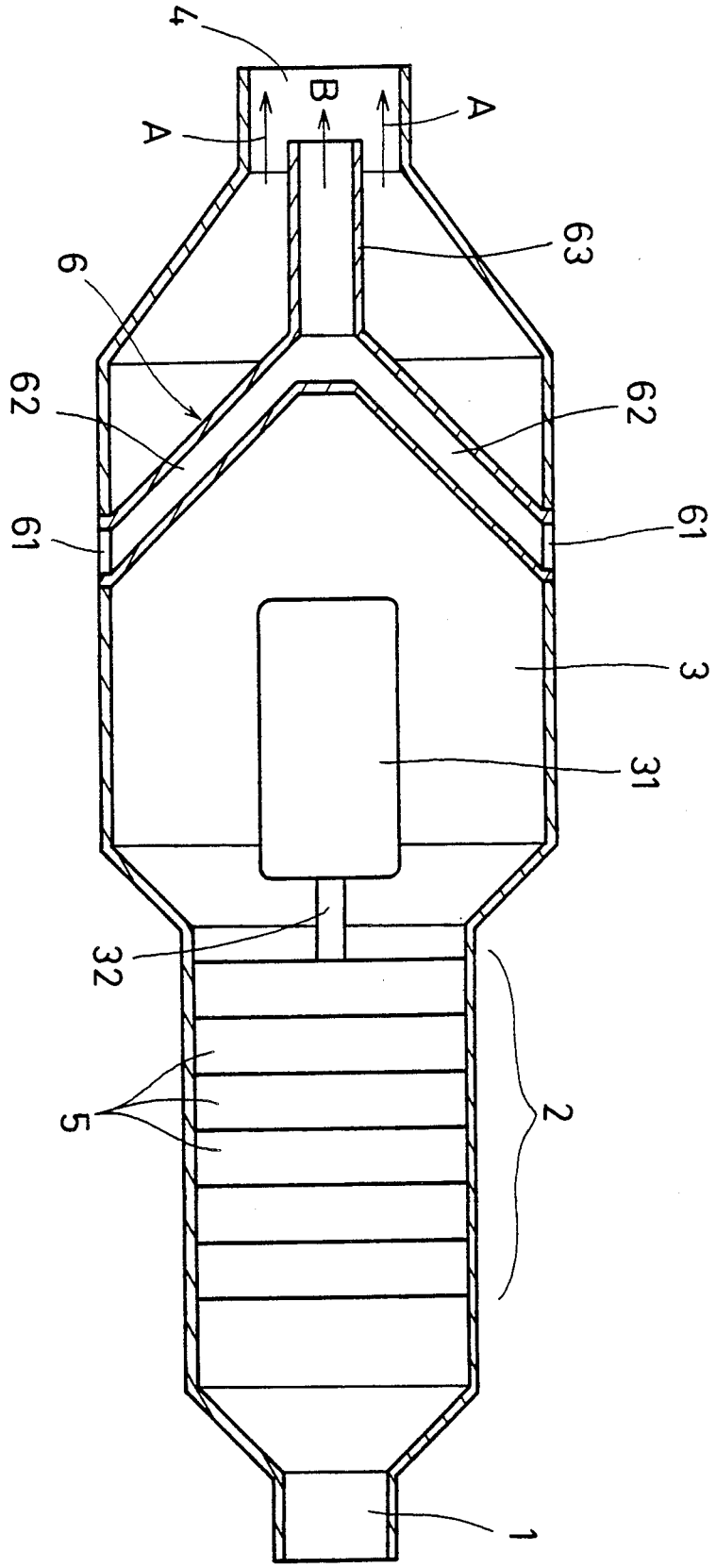
FIG. 4 is a sectional view of an air pump in accordance with the first embodiment of this invention.

The construction of the air pump according to the first embodiment of this invention will now be described mainly with reference to FIG. 4. Similar to the conventional air pump shown in FIGS. 1 through 3, this air pump also comprises a primary air intake conduit 1, a multi-stage centrifugal compressing section 2, a motor chamber 3 as well as a motor 31 received therein, and a discharge conduit 4. Since the construction and function of the above-described members are identical to the conventional air pump mentioned above and illustrated in FIGS. 1 through 3, the description thereof is thus omitted. In addition, this air pump further comprises at least one secondary air inlet 61 provided in the wall of the motor chamber 3 and a set of secondary air intake pipeline 6 extending from the secondary air inlet 61 to the discharge conduit 4. The secondary air intake pipeline 6 comprises a secondary exit pipe 63 generally coaxial with the discharge conduit 4, and at least one connecting pipe 62 each of which connecting a secondary air inlet 61 to the secondary exit pipe 63. The secondary air B inhaled through the secondary air inlet 61 is isolated from the primary air A inhaled through the primary air intake conduit 1 by the secondary air intake pipeline 6 until it reaches the end of the secondary exit pipe 63 where the later communicates into the discharge conduit 4 and thus the secondary air B mixes with the primary air A. At the beginning of the compression operation, the primary air A entering the air pump if first compressed in the multi-stage centrifugal compressing section 2 in the same way as described above with respect to a conventional air pump and then accelerated within the discharge conduit 4 having a profile similar to a nozzle so as to produce a lower pressure in the vicinity of the end portion of the secondary exit pipe 63. The produced lower pressure, in turn, inhales secondary air B from the outside of the air pump through the secondary air intake pipeline 6 so that the secondary air B together with the primary air A may be pumped into an inflatable article connected to the discharge conduit 4. Due to the addition of extra secondary air B to the total air supply, rather than merely the primary air A as in the case of a conventional air pump, this air pump can inflate an inflatable article in a more speedy manner as compared with a conventional multi-stage centrifugal compressor or air pump described above and shown in FIGS. 1 to 3.

Figure 5:
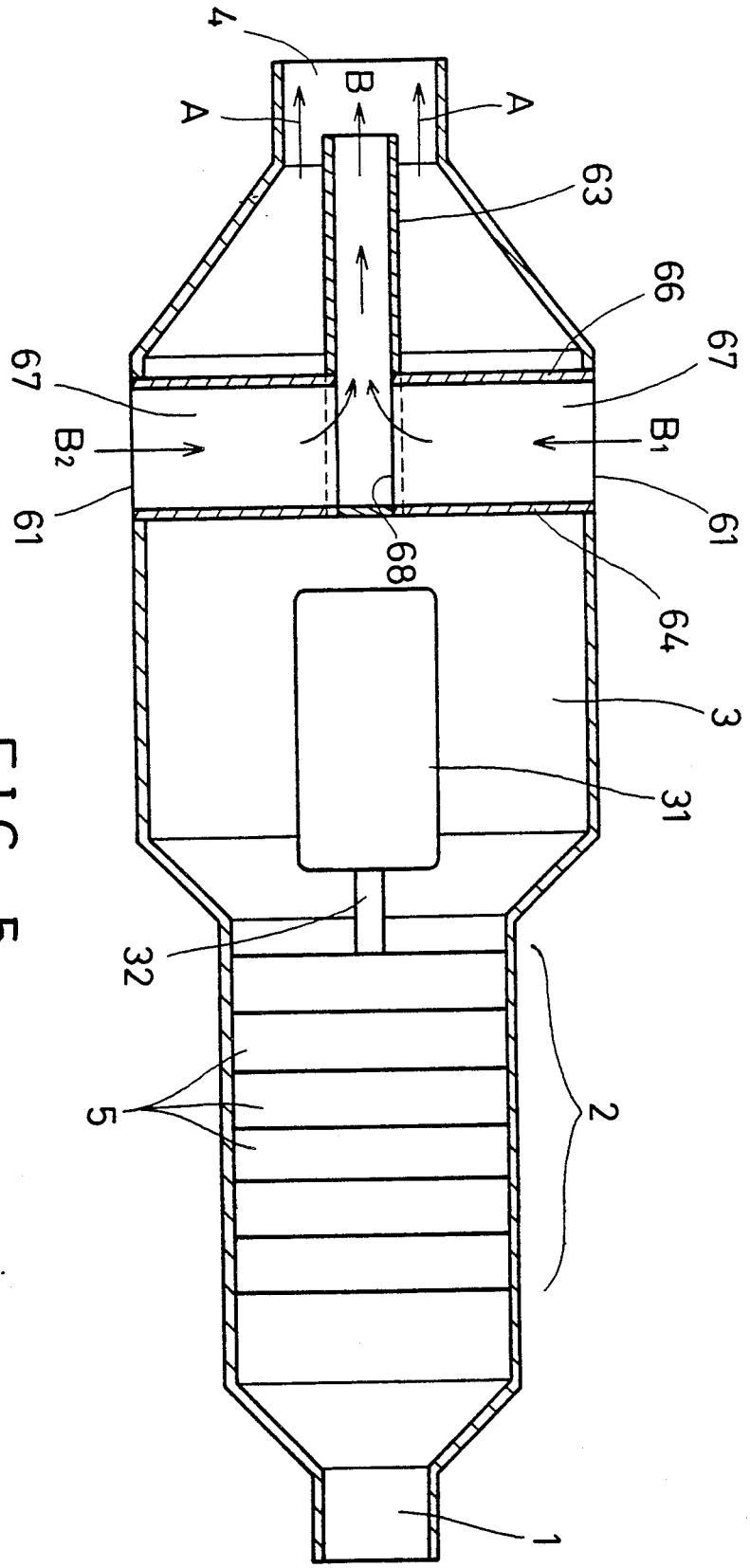
FIG. 5 is a sectional view of an air pump in accordance with the second embodiment of this invention.
Figure 6:
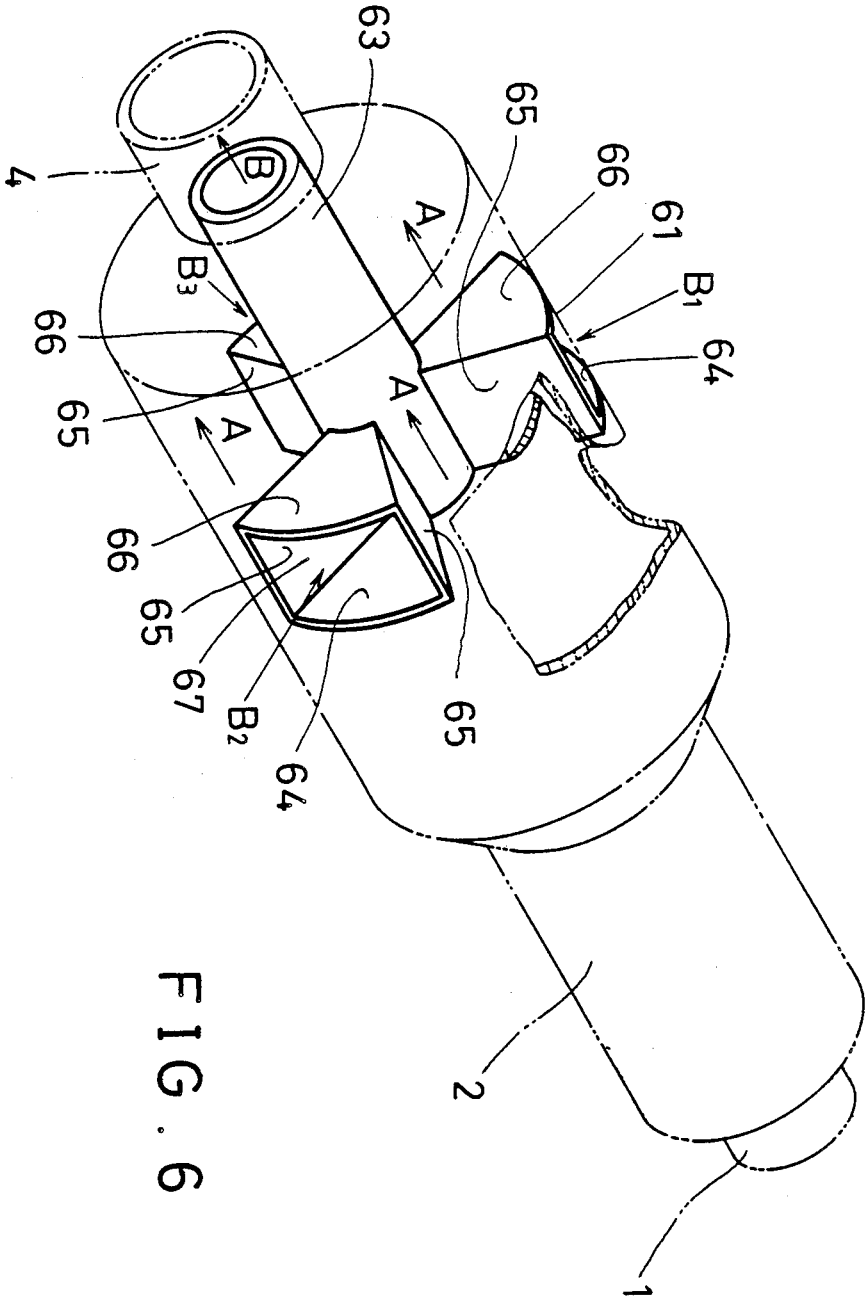
FIG. 6 is a perspective view of the secondary air pipeline in the air pump shown in FIG. 5, with the housing of the air pump being shown by phantom lines.

FIGS. 5 and 6 show the construction of an air pump in accordance with the second embodiment of this invention. This air pump has generally the same structure as the first embodiment, with the exception that several connecting chambers 67, instead of connecting pipes 62, are used to connect the secondary air inlets 61 to the secondary exit pipe 63. Each connecting chamber 67 is formed by four surrounding walls 64, 65, 66 and 65. Each connecting chamber 67 is connected, at its diametrically outer end, to a secondary air inlet 61 and, at its diametrically inner end, to an opening 68 (see FIG. 5) provided in the wall of secondary exit pipe 63 so that secondary air B may be inhaled through the secondary air inlets 61 (along the directions of arrows B1, B2 and B3) and the connecting chambers 67, and then enters the secondary exit pipe 63. The working principle of the air pump according to this second embodiment is identical to that of the above-described first embodiment. However, in the air pump of the second embodiment, the secondary air intake pipeline 6 can be integrally formed with the housing of the air pump by injection molding. Consequently, the manufacturing cost can be greatly reduced.

Figure 7:
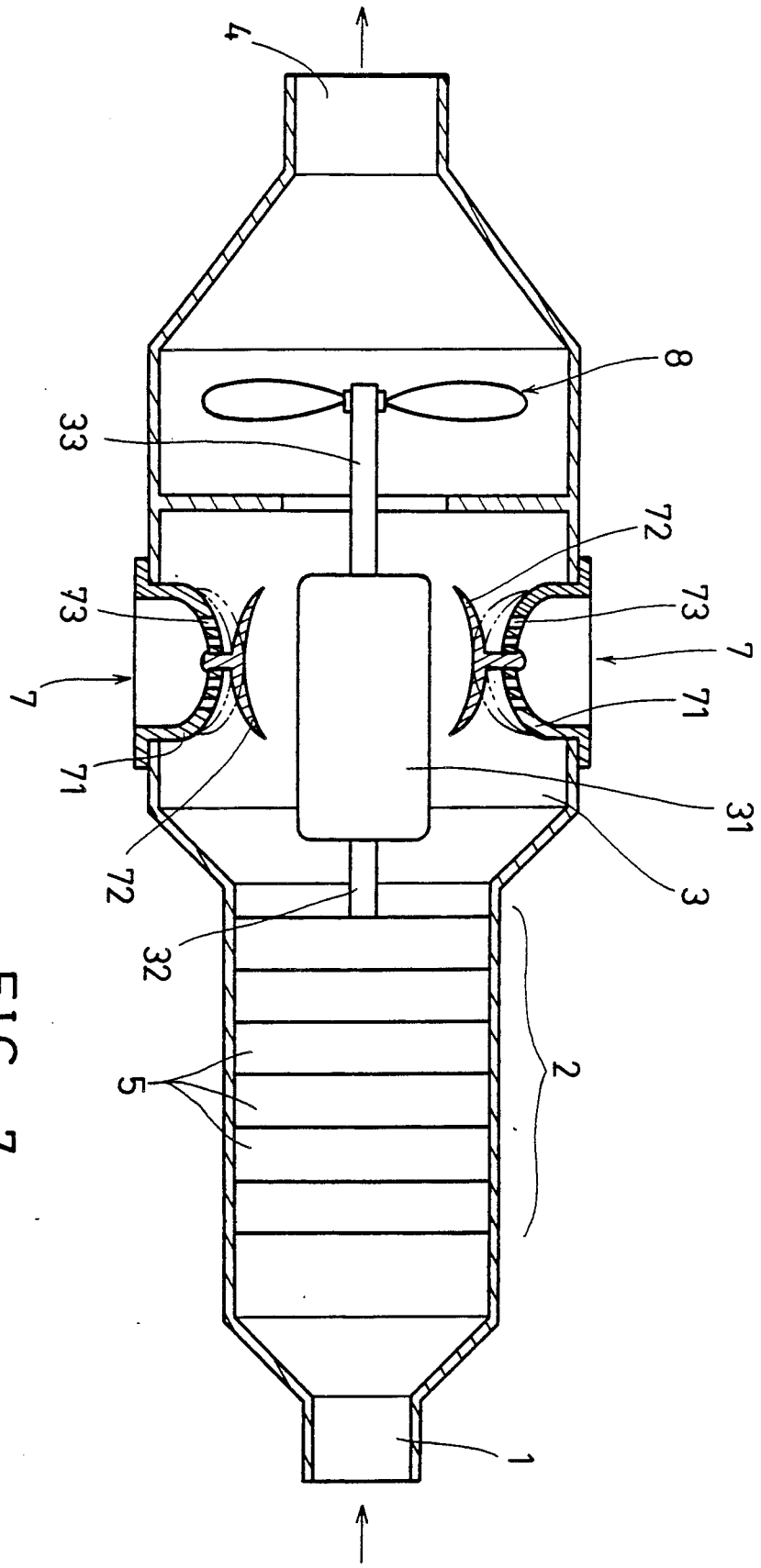
FIG. 7 is a sectional view of an air pump in accordance with the third embodiment of this invention.

Next, the construction of the air pump in accordance with the third embodiment of this invention will be described mainly by referring to FIG. 7. Similar to the conventional air pump shown in FIG. 1, this air pump also comprises a primary air intake conduit 1, a multi-stage centrifugal compressing section 2, a motor chamber 3 as well as a motor 31 received therein, and a discharge conduit 4. Since the construction and function of the above-described members 1, 2, 3, 31 and 4 are identical to that of the conventional air pump mentioned above and illustrated in FIGS. 1 through 3, the description thereof is thus omitted. In this air pump, however, the shaft of the motor 31 also extends toward the opposite side of the multi-stage centrifugal compressing section 2 to form a rear shaft 33 on which is mounted a blower 8. In addition, at least one air valve 7 is installed in the peripheral wall of the motor chamber 3 downstream of the multi-stage centrifugal compressing section 2. Each air valve 7 comprises a valve body 71 with a plurality of vent holes 73 through which the interior of the air pump may communicate with the outside, and a gate member 72 fixed to the valve body 71 at the center. In this embodiment, the gate member 72 is shown to be a film made of flexible material (such as, plastic), and may be flexed outward along its periphery because of diametrically outward pressure to cover and seal all the vent holes 73 so that air leakage may be avoided when the inner pressure of the article being inflated is over the predetermined range. Alternatively, a resilient member such as a spring (not shown) may be interposed between the gate member 72 and the valve body 71 so that the gate member 72 may be forced to move diametrically outward and seal the vent holes 73 of the air valve 7 when the inner pressure of the inflatable article and thus the pressure on the diametrically inner side of the gate member 72 increase to an extent capable of overcoming the spring force of the resilient member. Through the cooperation of the blower 8 and air valve 7, it becomes possible to inhale extra secondary air into the air pump so as to accelerate the inflation operation. The function of the air valve 7 will now be described. First, when the inner pressure within the article to be inflated is very lower at the beginning of the inflation operation, the gate member 72 (shown in FIG. 7 by a solid line) is designed to be spaced from the valve body 71 and thus does not seal the vent holes 73 in the valve body 71. Thus the valve 7 is open, and extra secondary air, greater in quantity compared with the primary air inhaled through the primary intake conduit 1 by the multi-stage compressing section 2, is rapidly introduced into the air pump by the blower 8 and pumped into the inflatable article together with the primary air. When the inner pressure of the inflatable article gradually increases to a certain range, for example 0.2 psi, no further inflation by the blower 8 is possible due to the performance limitation of the blower, which is applicable only in a lower pressure range. Meanwhile, according to a proper design, the gate member 72 will be forced to seal the vent holes 73 in the valve 7 (shown by the doted lines in FIG. 7) by the increased pressure within the inflatable article and within the motor chamber 3 to avoid possible air leakage. Thereafter, the multi-stage centrifugal compressing section 2 solely continues the inflation by pumping only primary air into the article. Accordingly, the embodiment makes possible the automatic switching of the inflation operation from a larger quantity, lower pressure mode, in which air of lower pressure is pumped into an inflatable article at a higher flow rate mainly by the blower 8, to a higher pressure, smaller quantity mode, in which air of higher pressure is pumped into the same article at a lower flow rate solely by the multi-stage compressing section 2. Thanks to the possibility of switching the operation modes, according to the third embodiment of this invention, the inflation operation can be carried out in a more speedy manner without reducing the pressure of the pumped air, when compared with a conventional multi-stage centrifugal compressor or air pump described above. Although the air valve capable of closing or opening in an automatic manner has been mentioned as an example, manually-operated air valves may also be selected for the same purpose.

In the aforementioned air pumps, the primary intake conduit 1 and the discharge conduit 4 may, preferably, have the same diameters so that an inflatable article may optionally be connected to the discharge conduit 4 for inflation or to the primary intake conduit 1 for deflation.

While the invention has been described in terms of several preferred embodiments, it is to be understood that the invention need not be limited to the disclosed embodiments. On the contrary, it is intended to cover various modifications and similar arrangements included within the spirit and scope of the appended claims.

What is claimed is:

1. An air pump for inflating an inflatable article, comprising:

a housing;

a primary intake conduit for introducing primary air into said air pump;

a motor including a shaft for providing rotation power to said air pump;

a multi-stage centrifugal compressing section including a plurality of compressing units connected in series and driven by said motor shaft, each of said compressing units including a stator fixed to said housing of said air pump and a rotor which is fixed to said motor shaft and is received within a corresponding stator, said rotor including a plurality of blades so that air entering each of said compressing units may be compressed gradually by centrifugal force produced by the rotation of said blades together with said motor shaft;

a discharge conduit downstream of said multi-stage centrifugal compressing section for introducing compressed air into said inflatable article, said discharge conduit having a nozzle-like profile so as to accelerate said primary air passing therethrough;

said air pump further including, between said multi-stage centrifugal compressing section and said discharge conduit, at least one secondary air inlet through which secondary air may be introduced into said air pump and at least one air valve for opening said at least one secondary air inlet when the pressure inside of said secondary air inlet is below a predetermined level, and closing said secondary air inlet when the pressure inside of said secondary air inlet is over a predetermined level; and a blower downstream of said multi-stage centrifugal compressing section for inhaling secondary air rapidly through said secondary air inlet into said air pump at the beginning of inflation so as to accelerate the inflation.

2. An air pump as described in claim 1 wherein said at least one air valve is an automatic air valve, each of which includes a valve body having a plurality of vent holes provided therethrough, and a gate member which remains open when the pressure inward of said gate member is below a predetermined level, and which seal said vent holes automatically when the pressure inward of said gate member is over said predetermined level.

3. An air pump as described in claim 2, wherein said gate member is a flexible film provided adjacent to and inside of said vent holes; said flexible film remains spaced from said vent holes so as to keep said air valve open when the pressure inward of said film is below said predetermined level; and said flexible film is forced to flex outward and seal said vent holes so as to close said air valve when said pressure inward of said film is over said predetermined level.

4. An air pump as described in claim 2, wherein said gate member comprises a sealing member and a resilient member interposed between said sealing member and said valve body; and wherein said resilient member keeps said sealing member spaced from said vent holes so as to make said air valve open when the pressure inward of said sealing member is below said predetermined level; and said resilient member is deflected to make said sealing member touch and seal said vent holes so as to close said air valve when the pressure inward of said sealing member is over said predetermined level.

5. An air pump as described in claim 1, wherein said blower is fixed to and driven by said motor shaft.

6. An air pump as described in claim 1, wherein said primary intake conduit and said discharge conduit have the same diameters so that an inflatable article may be optionally connected to said discharge conduit for inflation or to said primary intake conduit for deflation.

* * * * *